US008839939B2

(12) United States Patent
Brown

(10) Patent No.: US 8,839,939 B2
(45) Date of Patent: Sep. 23, 2014

(54) ICE VENDING MACHINE WITH WALL MOUNT WATER TELLER

(76) Inventor: Donald Ray Brown, Roswell, GA (US)

( * ) Notice: Subject to any disclaimer, the term of this patent is extended or adjusted under 35 U.S.C. 154(b) by 0 days.

(21) Appl. No.: 13/527,024

(22) Filed: Jun. 19, 2012

(65) Prior Publication Data

US 2012/0318635 A1 Dec. 20, 2012

Related U.S. Application Data

(60) Provisional application No. 61/498,777, filed on Jun. 20, 2011.

(51) Int. Cl.

| | |
|---|---|
| ***B67D 7/02*** | (2010.01) |
| ***B67D 7/84*** | (2010.01) |
| ***G07F 9/10*** | (2006.01) |
| ***G07F 13/00*** | (2006.01) |
| ***G07F 17/00*** | (2006.01) |

(52) U.S. Cl.

CPC .. *G07F 17/0071* (2013.01); *B67D 2210/00031* (2013.01)

USPC ..... 194/350; 222/2; 222/173

(58) Field of Classification Search

USPC ..... 194/350, 353; 222/2, 108, 146.1, 146.6, 222/173, 630, 192; 312/100, 101, 198, 199, 312/229, 236, 237

See application file for complete search history.

(56) References Cited

U.S. PATENT DOCUMENTS

| | | | | |
|---|---|---|---|---|
| 5,314,091 | A * | 5/1994 | Credle, Jr. | 222/129.1 |
| 5,350,082 | A * | 9/1994 | Kiriakides, Jr. et al. | 221/1 |
| 5,391,293 | A * | 2/1995 | Hansen | 210/109 |
| 5,582,717 | A * | 12/1996 | Di Santo | 210/86 |
| 6,093,312 | A * | 7/2000 | Boulter | 210/86 |
| 6,926,170 | B2 * | 8/2005 | Groesbeck | 222/63 |
| 7,735,527 | B2 | 6/2010 | Dunn | |

* cited by examiner

*Primary Examiner* — Mark Beauchaine

(74) *Attorney, Agent, or Firm* — Thomas|Horstemeyer, LLP

(57) ABSTRACT

The present disclosure describes an ice vending machine with a water vending teller that is mounted on an exterior side of the ice vending machine.

15 Claims, 8 Drawing Sheets

ICE VENDING MACHINE WITH WALL MOUNT WATER TELLER

CLAIM OF PRIORITY

This application claims priority to and the benefit of U.S. provisional application Ser. No. 61/498,777 filed on Jun. 20, 2011, which is incorporated herein by reference in its entirety.

FIELD OF THE INVENTION

The present disclosure relates to ice vending machines, and more particularly, to systems, methods, and apparatus for providing water vending in connection with the ice vending machines.

BACKGROUND

Ice vending machines that dispense ice or bags of ice to a customer after an onsite payment are well known in the art. An example of an ice vending machine is shown and described in U.S. Pat. No. 7,735,527, which is incorporated herein by reference in its entirety. This type of machine is commercially available for purchase from Ice House America, Inc., which is the assignee of the patent. This machine is typically the size of a small building and oftentimes comprises a plurality of interior rooms. In one room, which is maintained at or below water freezing temperature, ice is made and stored. The ice is then transported into another interior room with a higher nonfreezing temperature having a service door to the outside as well as an ice dispensing opening, where the ice is dispensed to the exterior when a customer makes a purchase with money and/or a credit card. In some implementations, the ice is dispensed as either ice or ice in a plastic bag, as selected by the customer.

Water vending machines that dispense water to a customer's bottle or other customer-provided storage vessel after an onsite payment are well known in the art. Furthermore, current owners of ice vending machines wish to install some type of water vending machine on or in connection with their existing ice vending machines in order to provide customers with both ice and potable drinking water.

One current design of a water vending machine that has been available in the marketplace for use in connection with an ice vending machine is a smaller teller version that is essentially retrofitted into an ice vending machine. This smaller teller version is mounted above ground at a level that enables a customer to operate it without having to bend down. This current water teller design requires an installer to undesirably cut out a very large rectangular opening in a wall of the ice vending machine, which is typically the size of the water teller, in order to install the teller. The water teller is then inserted into this opening from within the ice vending machine and electrical power, water supply, and sometimes drainage lines are connected to the teller from inside the ice vending machine. Furthermore, the teller is usually installed in a wall of the room that does not make/store ice, because of the significant requisite compromise to the insulation. Also, monies pertaining to water purchases are collected from the inside of the ice vending machine.

The current water teller design has at least two major shortcomings. While being secure, this design limits the amount of available locations on the building in which it can be installed due to conflicting, installed, inside hardware and accessibility for service. In addition, when these stainless steel tellers are installed in an ice vending machine, there is a significant compromise of the insolation (the R rating) due to cutting such a large hole in one of its exterior walls.

SUMMARY OF INVENTION

The present disclosure describes, among other things, embodiments of an ice vending machine with a water vending teller that is mounted on an exterior side of the ice vending machine. Accordingly, a large hole does not need to be cut into an insulated wall of the ice vending machine, and one or more tellers can be placed virtually anywhere along the exterior walls of the ice vending machine.

In one embodiment, among others, the ice vending machine has a housing with a top side, a bottom side, and vertical sides connecting the top and bottom sides. The housing has an interior room having ice for sale. The ice vending machine is designed to dispense the ice to an exterior of the ice vending machine through a first opening in one of the sides upon payment by a customer. The water vending teller has a housing with a top side, a bottom side, vertical sides connecting the top and bottom sides, a front side, and a rear side. The front side has at least one door enabling access to an interior to enable servicing of operational components of the teller as well as collection of monies from the front side of the teller. The housing has an interior room having water for sale. The water vending teller is designed to dispense water through a second opening in the front side of the water vending teller upon payment by the customer. The rear side mounted to an exterior surface of one of the vertical sides of the ice vending machine.

The present disclosure also provides a water vending teller kit that can be sold. The kit includes a water vending teller and a means for mounting the teller to an ice vending machine.

The present disclosure further provides methods for installing a water vending teller on or in connection with an ice vending machine. One such method, among others, can be summarized by the following steps: (a) providing the ice vending machine having a housing with a top side, a bottom side, and vertical sides connecting the top and bottom sides, the housing having an interior room, the interior room having ice for sale, the ice vending machine designed to dispense the ice to an exterior of the ice vending machine through a first opening in one of the sides upon payment by a customer; and (b) installing the water vending teller having housing with a top side, a bottom side, vertical sides connecting the top and bottom sides, a front side, and a rear side, the front side having at least one door enabling access to an interior to enable servicing of operational components of the teller from the front side, the housing having an interior room, the interior room having a water for sale, the water vending teller designed to dispense water through a second opening in the front side of the water vending teller upon payment by the customer, the rear side mounted to an exterior surface of one of the vertical sides of the ice vending machine.

Other systems, methods, apparatus, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWING FIGURES

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

This new water vending teller design eliminates the two obstacles described in the Background by mounting the water vending teller directly to a wall of the ice vending machine so that there is service access to the operational components and monies from the front side of the teller. This design requires no large opening, instead only three small holes are required for water intake, drain, and power. Also, by designing a wall mounting teller, the depth of the unit can be greatly reduced than that of a standard stand-alone water vending machine saving valuable space around the ice vending machine. Further, the teller can be installed with an optional base, as shown in 7, with one or both bolted to the exterior wall of the ice vending machine. The base can be a support or non-support structure for the water vending teller. While the description of the present disclosure focuses on a dual vendor (dual water dispensers), a water vending teller with a single vendor (single water dispenser) is an alternative embodiment.

How to Manufacture

Figure 1:
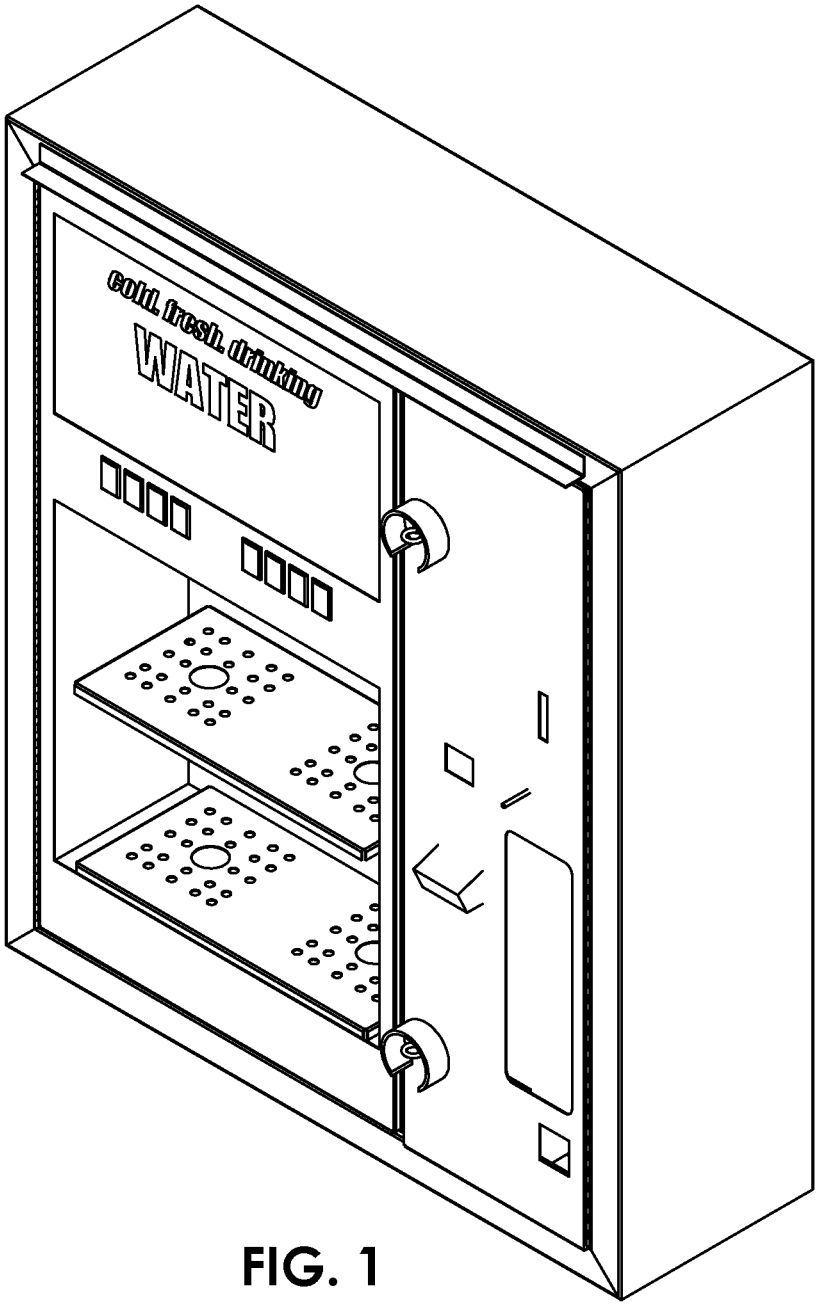
FIG. 1 is a perspective view of the wall mountable water vending teller of the present disclosure.

In FIG. 1, there is shown, in perspective, a preferred embodiment of the present invention, which comprises a wall mountable vending teller which fills customer supplied bottles with liquids, for example but not limited to, purified reverse osmosis (RO) drinking water. The water vending teller is generally rectangular in shape and the housing is preferably manufactured from metal, but other materials, such as plastic could be utilized. Front and rear views of the teller are shown in FIGS. 2 and 3, respectively.

Figure 2:
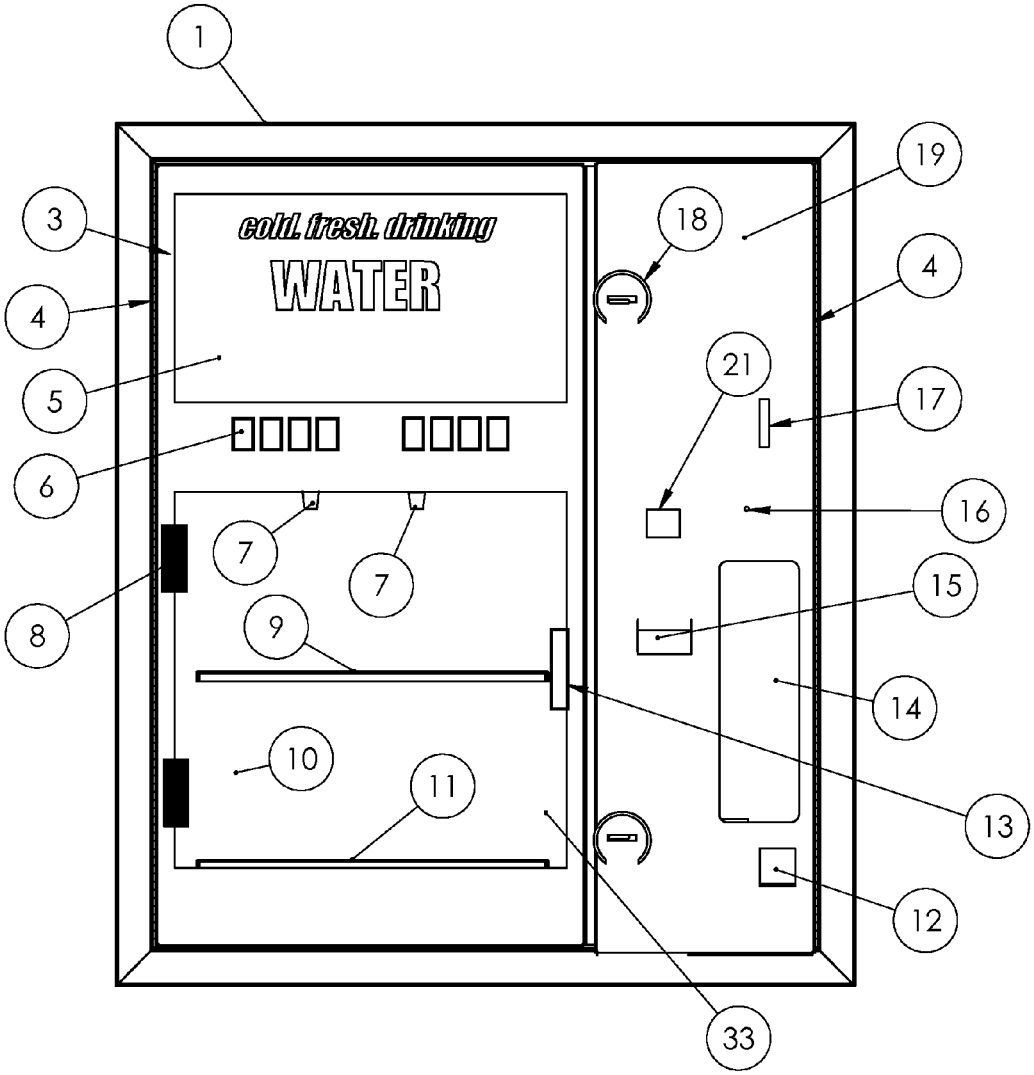
FIG. 2 is a front view of the water vending teller of FIG. 1.
Figure 3:
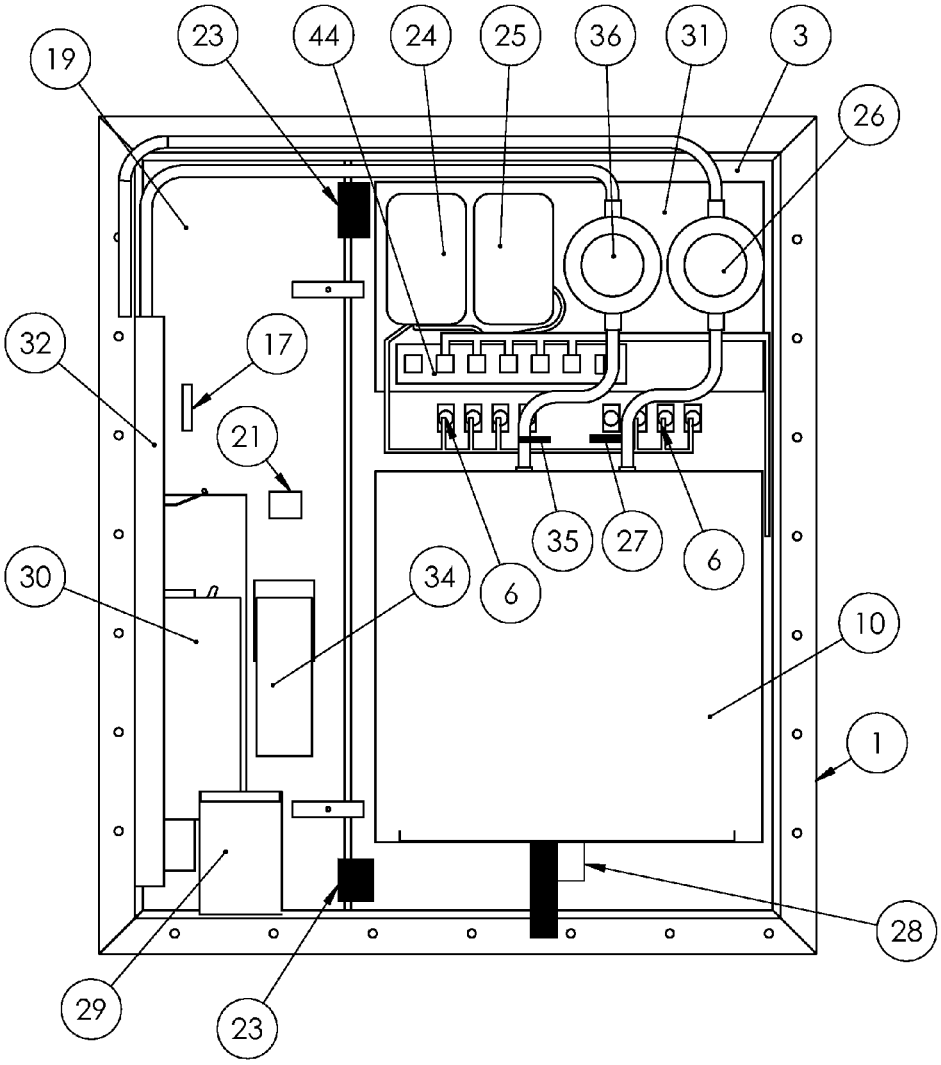
FIG. 3 is a rear view of the water vending teller of FIG. 1.

Referring to FIGS. 2 and 3, the water vending teller comprises a generally rectangular housing cabinet 1 having at least one door, but preferably two side-by-side doors that enables easy access to the internal elements to enable servicing of operational components of the teller from the front side. The two doors are a very beneficial feature. The two door configuration enables opening of the cabinet to collect monies, which is frequent, without opening and exposing most of the internal operational components. Two doors also helps prevent the atmospheric wind from suddenly taking and forcing a door away from a user's hand (due to lesser surface area in each door as compared to one large door) to thereby cause damage to surrounding parts, etc. Finally, the two door configuration works better than one door, because the heavy one door is replaced with two lighter doors, enabling easier maneuverability and less long term wear on the hinges, etc.

A filling station door 3 and a monetary currency door 19, both of which open and close, use piano hinges 4 and are locked by two hockey puck locks 18. On the filling station door 3 is mounted a vending chamber 10 which comprises a top filling shelf 9 to be used for smaller bottles and bottom filling shelf 11 for larger bottles.

The customer accesses this vending chamber 10 by opening a self-closing vend door 33, which comprises two spring-loaded hinges 8 and a door handle 13.

Also, on the filling station door 3 are a plurality of vend buttons 6, totaling eight in the preferred embodiment, to be used to fill various amounts of water from two separate filling nozzles 7. Above the vend buttons 6 is a lighted graphic panel 5 for advertisement of the operator's product.

On the currency door 19 is located an LED (light emitting diode) credit display 21 in addition to a coin return button 16 for causing coins to be returned after deposited, a coin slot 17 for receiving coins, a bill validator slot 15 for receiving paper money, and an instruction panel 14 for displaying instructions on how to operate the teller. Change is returned though the coin return cup 12.

In FIG. 3, there is shown the inner workings of the water teller. On the filling station door 3 is attached the vending chamber 10, which has a drain fitting 28 at the bottom and has right 27 and left 35 vending solenoids at the top. In addition, there is attached a light box 31 which has mounted on it a vending control box 24, a power relay box 25, and right 26 and left 36 volumetric vend meters. The filling station door can only be unlocked from the inside using two sliding pin locks 23.

On the currency door 19 is attached a coin mech 30, bill validator 15, LED credit display 21, and cash box 29. The currency door is opened by removing door locks 18, as shown in FIGS. 1 and 2. Furthermore, a dual pass UV sterilizer 32 is attached to the wall of the cabinet 1.

Plumbing Architecture

Figure 4:
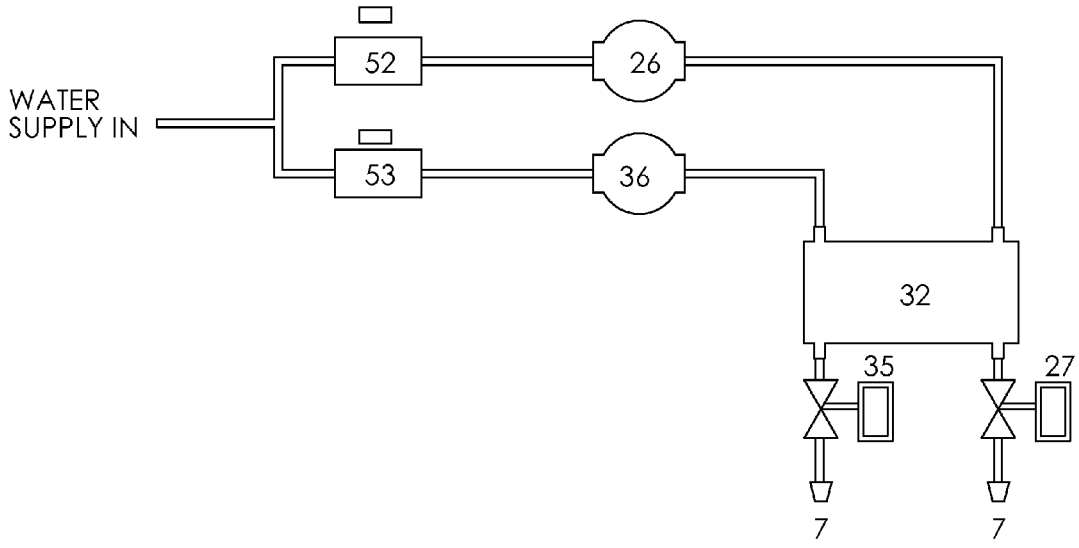
FIG. 4 is a schematic water flow diagram of the plumbing associated with the water vending teller of FIG. 1.

FIG. 4 is a schematic water flow diagram of the plumbing associated with the water vending teller of FIG. 1, which supplies the water for dispensing. The operator supplies water to the water vending teller usually installing ¾" PVC pipe with tees to two separate ½" lines which have install a right 1 and left side ½" PVC ball valve, which are used for shutting off water for servicing. The water then is metered out though the right 3 and left 4 flowmeter. The flowmeters send a pulse though a switch closure of a microswitch which an MDB vend controller 11 uses to dispense the proper amount of water. The water is turned on and off using the right solenoid value 5 and left solenoid valve 6. These valves 5, 6 are turned off and on by the vend controller 11, which energize the right solid state vend relay 9 and left solid state vend relay 10. Upon energizing the solenoid valves 5, 6, the water flows through the right NAMA approved dispensing nozzle 7 and left NAMA approved dispensing nozzle 8 into the customer provided bottles.

Electrical Wiring Architecture

Figure 5:
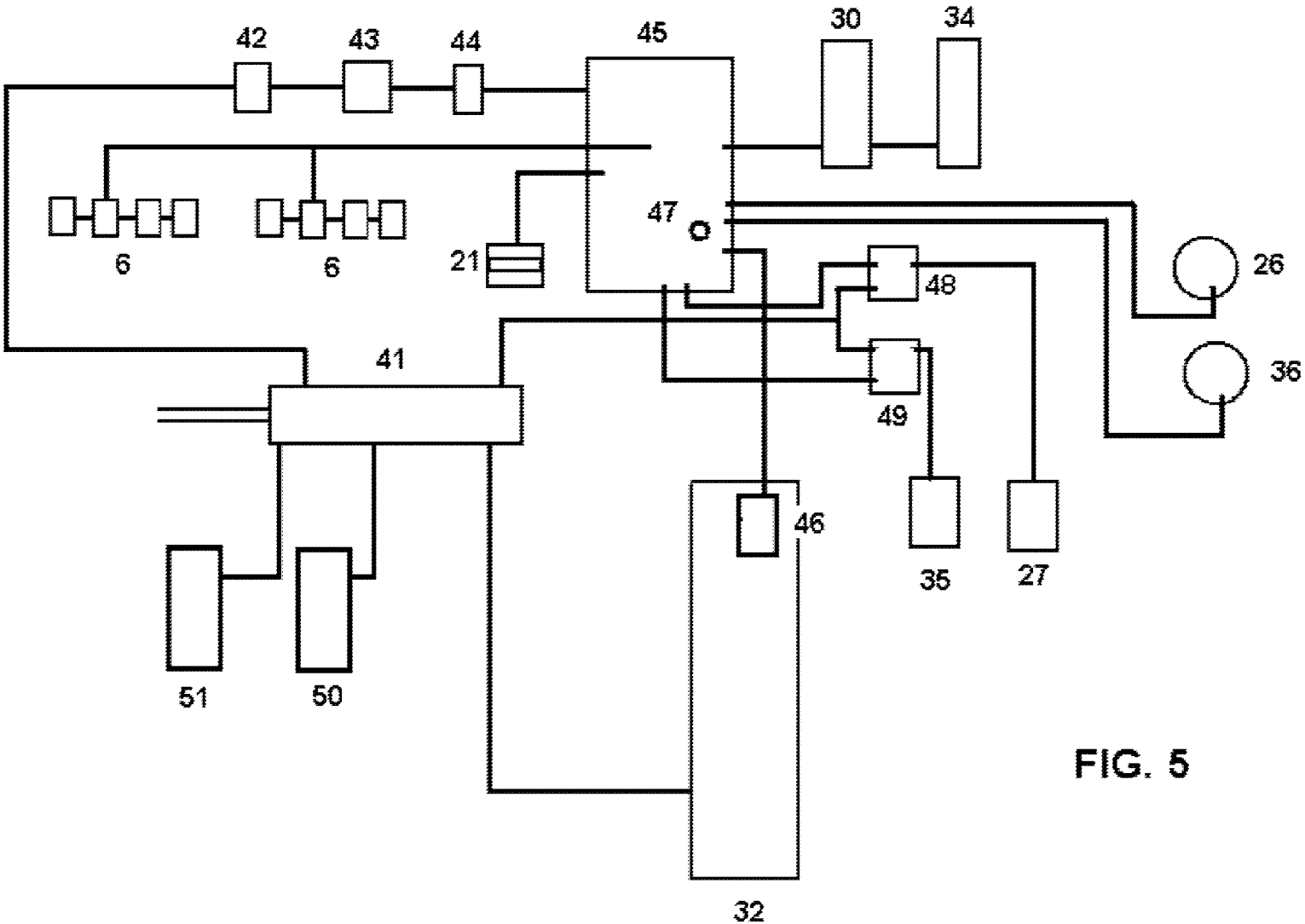
FIG. 5 is electrical wiring diagram of the water vending teller of FIG. 1.

FIG. 5 is electrical wiring diagram of the water vending teller of FIG. 1. The vend controller selectively controls power to the various elements to selectively turn elements on and off, as needed. One nonlimiting example of a suitable controller is the MDB vend controller, which is commercially available from Water Venders By Us, LLC, Atlanta, Ga., USA.

The wall teller vending functions are solely dependent on the MDB Vend controller and all additional parts are there to support the reliable control of the vending process. To better understand this process a detail description is as follows.

110 volts AC VAC power is supplied by the power strip 1, which has a fused on/off switch that turns power off to all components on the teller. 24 VAC power is supplied to the MDB controller by passing 110 VAC through an EMI Filter 2 and a 24 VAC transformer 3 and finally a fuse 4. The MDB Vend Controller 5 utilizes a programmed software chip to interpret various inputs and upon receiving them, generates desired outputs.

The inputs are as follows. Each of the coin mechanism 6 and the bill validator 7 can receive monies from customers and send pulses for the various monetary values. The right vend meter 8 and left vend meter 9 measure out one gallon of water and generate a single switch closure pulse. The vending system is designed to sell out by disabling the coin and bill acceptance should the ultraviolet UV sterilizer 19 malfunction. This is accomplished by sensing the UV bulb utilizing the UV sold out sensor 10. The right 11 or left 12 selection switches allow customers to receive different volume amounts of water. The final input is the program button 13, which allows the operator via the selection switches to navigate through various menus to obtain sales information and change settings.

The outputs are as follows. When monies are received from the coin mechanism and bill validator, the MDB controller displays the amount on the LED display 14. When enough monies have been received and a selection is made, then the controller will energize the right 15 or the left 16 relay. Upon activating these relays, the right 17 or left 18 solenoid is energized to dispense water until the programmed vend pulses are achieved from the vend meter.

Finally, the right 20 and left 21 light fixtures are plugged directly into the power strip.

How to Install

FIGS. 6A through 6F show an example embodiment, among many other possible embodiments, for mounting the teller to the wall of the ice vending machine. The mounting bracket 20 is first installed with bolts and washers at the desired height. The teller is then lifted and hung on the installed bracket 20. The doors are opened and holes are drilled using hole pattern on teller two inch internal flange. Holes are drilled for water, power and drain. Water lines with shut off valves are connected to flow meters 26,36. A one-inch drain line is connected to drain fitting 28. A ground fault interrupter GFI box is installed on wall which the power strip plugs into.

Figure 6A:
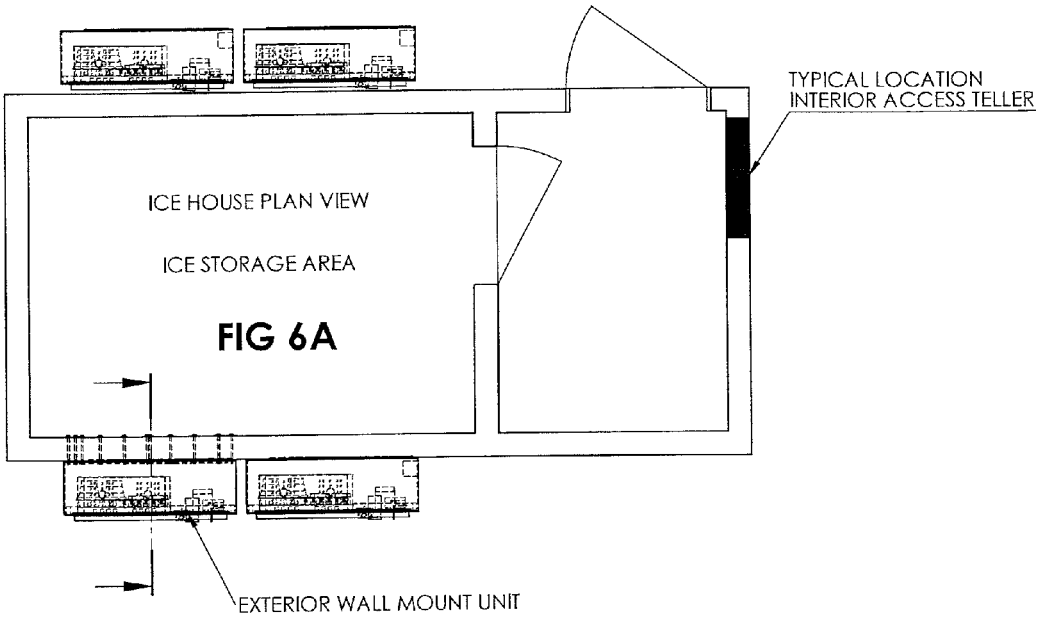
FIG. 6A is a top view of an ice vending machine to which the water vending teller is mounted.

As shown in FIG. 6A, the ice vending machine oftentimes has two rooms. The prior art configuration involved installing the water vending teller via an interior mount(s), as illustrated, in the wall of the non-ice-storage room. The water vending teller(s) of the present disclosure can be mounted virtually anywhere around the building (except for, obviously, in front of the door), even outside of the ice storage area. Four are shown in FIG. 6A, as a nonlimiting example.

Figure 6B:
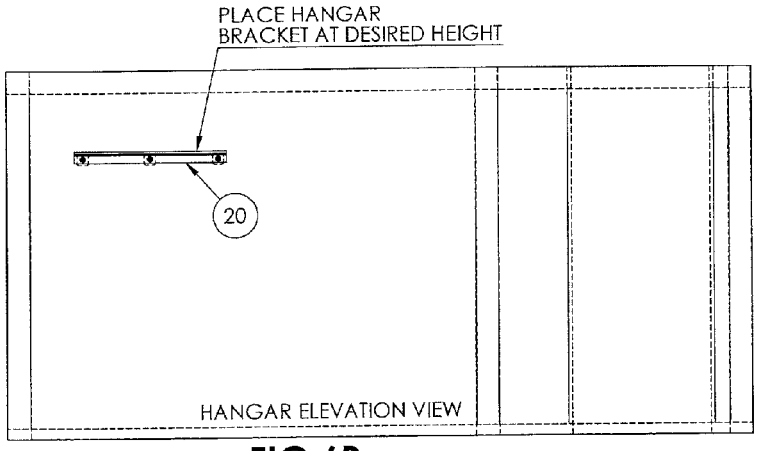
FIG. 6B is an elevational view of the ice vending machine of FIG. 6A, showing an example of how that water vending teller of FIG. 1 can be mounted wherein a hanger bracket is affixed to the exterior wall of the ice vending machine from which the water vending teller of FIG. 1 is hung.

FIG. 6B shows the hanger bracket that is used in the preferred embodiment to hang the water vending teller on the outside of the ice vending machine. The hanger is placed at a level that hangs the teller so that a customer does not need to bend down to operate the teller.

Figure 6C:
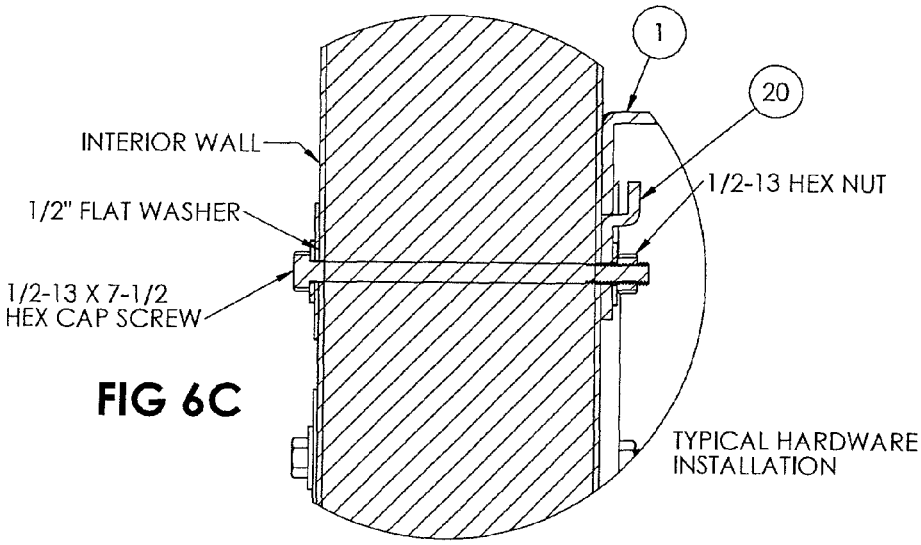
FIG. 6C is a cutaway view of a wall of the ice vending machine taken along the cutaway line of FIG. 6A, showing a mounting bolt configuration for attaching the hanger bracket to the exterior wall of the ice vending machine.
Figure 6D:
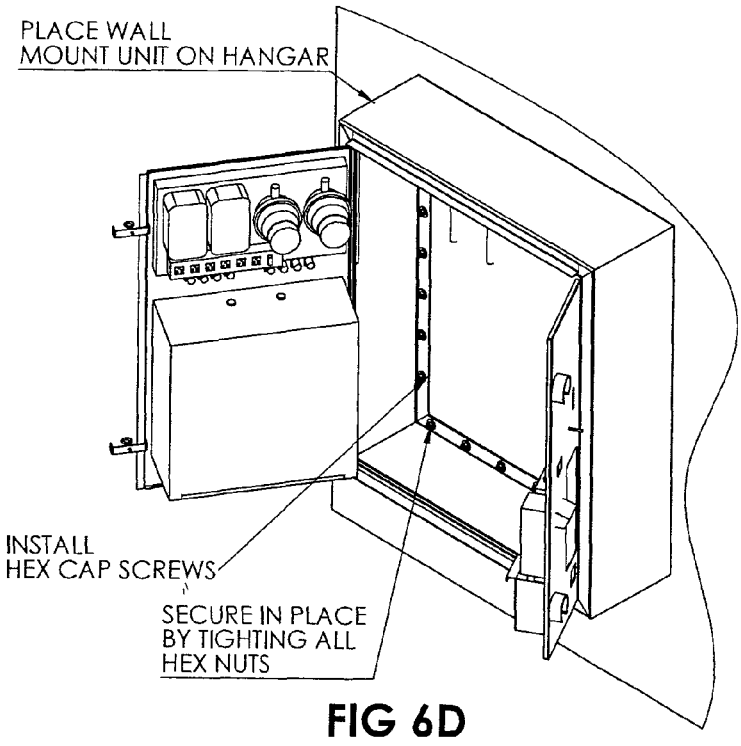
FIG. 6D is a perspective view of the water vending teller of FIG. 1 in an open configuration, showing two side by side doors for enabling front access to the interior of the water vending teller.
Figure 7:
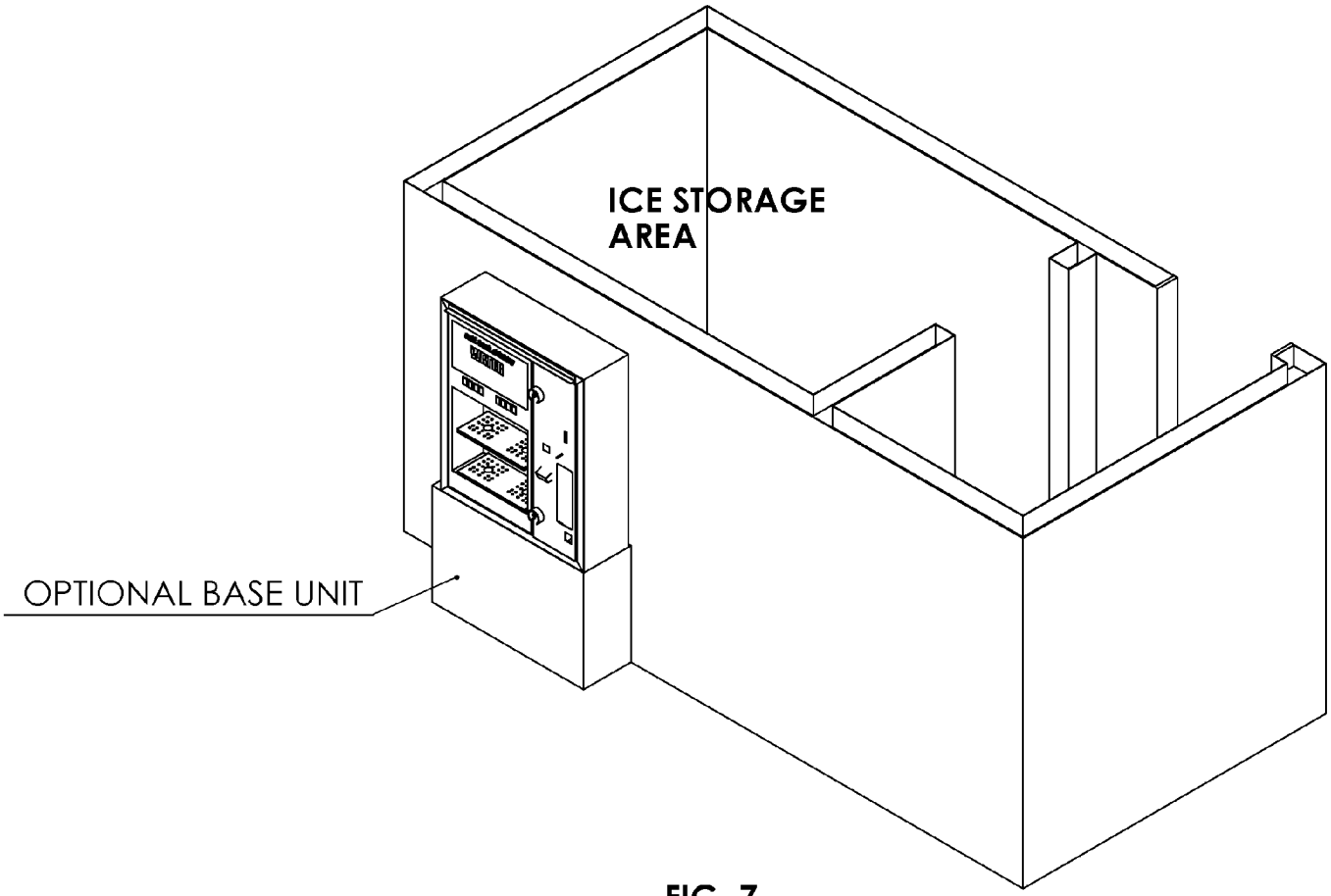
FIG. 7 is a perspective view of the ice vending machine (with top cutaway to show two contiguous rooms) with the attached water vending teller of FIG. 1 with an optional base that can provide some support for the teller.

FIG. 6C is a cutaway view of a wall of the ice vending machine taken along the cutaway line of FIG. 6A, showing a mounting bolt configuration for attaching the hanger bracket to the exterior wall of the ice vending machine. This FIG. 6C shows a cabinet lip (associated with the water vending teller) hanging on the hanger bracket, which is bolted to the exterior wall.

Note that, in the preferred embodiment, the electrical power, water supply, and drainage lines pass through the rear side of the teller and through the one vertical side of the ice vending machine where the teller is mounted. The lines supply electrical power, water, and drainage capabilities, respectively, to the teller from the ice vending machine. In an alternative embodiment, the electrical power, water supply, and drainage lines pass through the bottom or vertical sides of the teller.

How to Operate

FIGS. 1 and 2 show the components to use this dual filling bottle water teller. The customer opens the vend door 33 using the handle 13 and places a bottles into the vending chamber 10. If the customer has a one-gallon bottle, then the customer uses the upper shelf 9 or should the customer have a five gallon bottle, then the customer lifts the top shelf and places the bottle on the bottom shelf 11.

The customer then deposits monies into the teller through the coin slot 17 and/or the bill validator slot 15. Credit would be shown on the credit display 21. Once an ample amount of money is deposited, the customer makes a selection using the vend buttons 6 for the appropriate amount of water. Upon filling the a bottle(s), the customer accesses any change due by pushing the coin return button 16 and the proper change is returned using the coin return cup 12.

FIG. 3 shows the components used to dispense the proper amount of water. A water line is attached to the dual pass UV sterilizer 32, which is pressurized with purified water. Monies are accepted by the coin mechanism 30 and bill validator 34. Vending controller box 24 tracks the amount of money accepted and displays this amount on the LED credit display 21. When the customer pushes the vend buttons 6, the appropriate solenoid valve opens releasing water into the customers bottle. The proper amount is vended using a the volumetric flow meter 36 which signals the vending controller box 24 thereby turning off the appropriate solenoid valve 27. Any over flow water is channeled away from the vending chamber through the drain fitting 28.

Water Vending Teller Kit

A kit having the water vending teller and a mounting means can be made, offered for sale, and sold. For example, the water vending teller kit can be packaged to contain the following: a housing with a top side, a bottom side, vertical sides connecting the top and bottom sides, a front side, and a rear side, the front side having two side by side doors enabling access to an interior to enable servicing of operational components of the teller from the front side, the housing having an interior room, the interior room having vessel for storing water for sale, the water vending teller designed to dispense water through an opening in the front side of the water vending teller upon payment by the customer, the rear side mounted to an exterior surface of one of the vertical sides of the ice vending machine; and b attachment or mounting means for enabling attachment of the housing to a wall. As a nonlimiting example, the attachment means can include the hanger bracket, bolts, washers, and hex nuts shown in FIGS. 6A through 6E.

Variations

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention.

As an example of a variation, the water vending teller of the present disclosure can be attached to any wall, not necessarily a wall of an ice vending machine as described. This alternative embodiment could be employed anywhere where a water vending machine is desirable and only limited space is available.

As another example of a variation, the attachment means may not include the hanger bracket. The water vending teller could be mounted to the exterior of the ice vending machine with merely bolts and corresponding hex nuts.

As still another example of a variation, the attachment means may include a different type of hanger, a plurality of hangers, or clamps.

As yet another example of a variation, the attachment means may be one or more welds or welded attachments.

At least the following is claimed:

1. A vending system, comprising:

an ice vending machine having insulated exterior walls and an interior room, the interior room being insulated for storing ice for sale, the ice vending machine being designed to dispense the ice to an exterior of the ice vending machine through an opening in the insulated exterior walls of the ice vending machine upon payment by a customer; and a water vending teller having a housing with a top side, a bottom side, vertical sides, a front side, and a rear side, the front side having at least one door for access to an interior of the water vending teller, the water vending teller being designed to dispense water through an opening in the housing of the water vending teller upon payment by the customer, the rear side of the water vending teller being mounted to one of the insulated exterior walls of the ice vending machine, the water vending teller being supplied with power and water by power and water supply lines that pass through the housing of the water vending teller and through a hole in the one of the insulated exterior walls of the ice vending machine.

2. The vending system of claim 1, further comprising a drainage line that passes through the housing of the water vending teller and through the hole in the one of the insulated exterior walls of the ice vending machine.

3. The vending system of claim 1, wherein the power and water supply lines pass through one of a bottom or rear side of the water vending teller and the hole in the one of the insulated exterior walls of the ice vending machine.

4. The vending system of claim 1, wherein the at least one door comprises first and second doors situated side by side, the first door for access to water plumbing features of the water vending teller and the second door for access to money collected by the water vending teller.

5. The vending system of claim 1, wherein a vending location of the ice vending machine and the water vending teller are different.

6. The vending system of claim 1, further comprising at least one other water vending teller mounted to the one of the insulated exterior walls of the ice vending machine.

7. The vending system of claim 1, further comprising a base situated under the water vending teller, the base including a top side, a bottom side, and one or more vertical sides, the base providing at least some vertical support to the water vending teller.

8. A vending system, comprising:

an ice vending machine having insulated exterior walls and an interior room, the interior room being insulated for storing ice for sale, the ice vending machine being designed to dispense the ice to an exterior of the ice vending machine through an opening in the insulated exterior walls of the ice vending machine upon payment by a customer;

a water vending teller having a housing with a top side, a bottom side, vertical sides, a front side, and a rear side, the front side having at least one door for access to an interior of the water vending teller, the water vending teller being designed to dispense the water through an opening in the housing of the water vending teller upon payment by the customer, the rear side of the water vending teller being mounted to one of the insulated exterior walls of the ice vending machine; and power, water, and drainage lines that pass through the housing of the water vending teller and through a hole in the one of the insulated exterior walls of the ice vending machine.

9. The vending system of claim 8, wherein the at least one door comprises first and second doors situated side by side, the first door enabling access to water plumbing features and the second door enabling access to money collected by the teller.

10. The vending system of claim 8, wherein a vending location of the ice vending machine and the water vending teller are different.

11. The vending system of claim 8, further comprising at least one other water vending teller mounted to the one of the insulated exterior walls of the ice vending machine.

12. The vending system of claim 8, further comprising:

a water filter within the housing of the water vending teller that filters the water; and a base situated under the water vending teller, the base including a top side, a bottom side, and one or more vertical sides, the base providing at least some vertical support to the water vending teller.

13. A vending system, comprising:

an ice vending machine having an insulated exterior wall and an interior space; and a water vending teller comprising:

a housing with a top side, a bottom side, vertical sides, a front side, and a rear side, the front side of the housing having at least one door for access to an interior of the water vending teller, the interior of the water vending teller having a vessel for storing water, the water vending teller being designed to dispense water through an opening in the housing of the water vending teller;

an attachment hanger to attach the rear side of the housing of the water vending teller to the insulated exterior wall of the ice vending machine; and power and water supply lines to pass through the housing of the water vending teller and through a hole in the insulated exterior wall of the ice vending machine.

14. The water vending teller of claim 13, further comprising a drainage line to pass through the housing of the water vending teller and through the insulated exterior wall of the ice vending machine.

15. The water vending teller of claim 13, further comprising a base including a top side, a bottom side, and one or more vertical sides, the base to provide at least some vertical support to the water vending teller.

* * * * *